US010620554B2

(12) United States Patent
Araki et al.

(10) Patent No.: US 10,620,554 B2
(45) Date of Patent: Apr. 14, 2020

(54) PHOTOCONDUCTOR UNIT, PROCESS CARTRIDGE, AND IMAGE FORMING APPARATUS

(71) Applicant: FUJI XEROX CO., LTD., Tokyo (JP)

(72) Inventors: Keishi Araki, Kanagawa (JP); Hiroki Ando, Kanagawa (JP); Hirofumi Iida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/525,508

(22) Filed: Jul. 29, 2019

(65) Prior Publication Data

US 2019/0346778 A1 Nov. 14, 2019

Related U.S. Application Data

(62) Division of application No. 15/956,754, filed on Apr. 19, 2018, now Pat. No. 10,386,738.

(30) Foreign Application Priority Data

Oct. 6, 2017 (JP) ..... 2017-195760

(51) Int. Cl.

| | |
|---|---|
| ***G03G 5/04*** | (2006.01) |
| ***G03G 5/10*** | (2006.01) |
| ***G03G 15/00*** | (2006.01) |

(52) U.S. Cl.
CPC ..... *G03G 5/04* (2013.01); *G03G 5/10* (2013.01); *G03G 15/00* (2013.01)

(58) Field of Classification Search
None
See application file for complete search history.

(56) References Cited

U.S. PATENT DOCUMENTS 8,086,140 B2 * 12/2011 Deguchi ..... G03G 15/751 399/159
2014/0044456 A1 * 2/2014 Yamashita ..... G03G 5/0436 399/159

* cited by examiner

*Primary Examiner* — Victor Verbitsky
(74) *Attorney, Agent, or Firm* — JCIPRNET

(57) ABSTRACT

A photoconductor unit includes a photoconductor and an electrode. The photoconductor includes a base member that is cylindrical and has a hardness that decreases with increasing distance from a first end toward a second end in an axial direction, and a photosensitive layer formed on an outer peripheral surface of the base member. The electrode is in contact with an inner peripheral surface of an open end portion of the base member at the first end.

5 Claims, 12 Drawing Sheets

H
220A
220
206
206A
205

H
206A
220
206
220A
222
205

H
220
206
222
205
206A
220A

PHOTOCONDUCTOR UNIT, PROCESS CARTRIDGE, AND IMAGE FORMING APPARATUS

CROSS-REFERENCE TO RELATED APPLICATIONS

This application is a divisional application of and claims the priority benefit of a prior application Ser. No. 15/956,754, filed on Apr. 19, 2018, now allowed. The prior application is based on and claims priority under 35 USC 119 from Japanese Patent Application No. 2017-195760 filed Oct. 6, 2017.

BACKGROUND

Technical Field

The present invention relates to a photoconductor unit, a process cartridge, an image forming apparatus, and a method for manufacturing a photoconductor unit.

SUMMARY

According to an aspect of the invention, there is provided a photoconductor unit including a photoconductor and an electrode. The photoconductor includes a base member that is cylindrical and has a hardness that decreases with increasing distance from a first end toward a second end in an axial direction, and a photosensitive layer formed on an outer peripheral surface of the base member. The electrode is in contact with an inner peripheral surface of an open end portion of the base member at the first end.

BRIEF DESCRIPTION OF THE DRAWINGS

An exemplary embodiment of the present invention will be described in detail based on the following figures, wherein.

DETAILED DESCRIPTION

A photoconductor unit, a process cartridge, and an image forming apparatus according to an exemplary embodiment of the present invention will now be described.

Image Forming Apparatus

The structure of an image forming apparatus 10 according to the present exemplary embodiment will be described.

Figure 1:
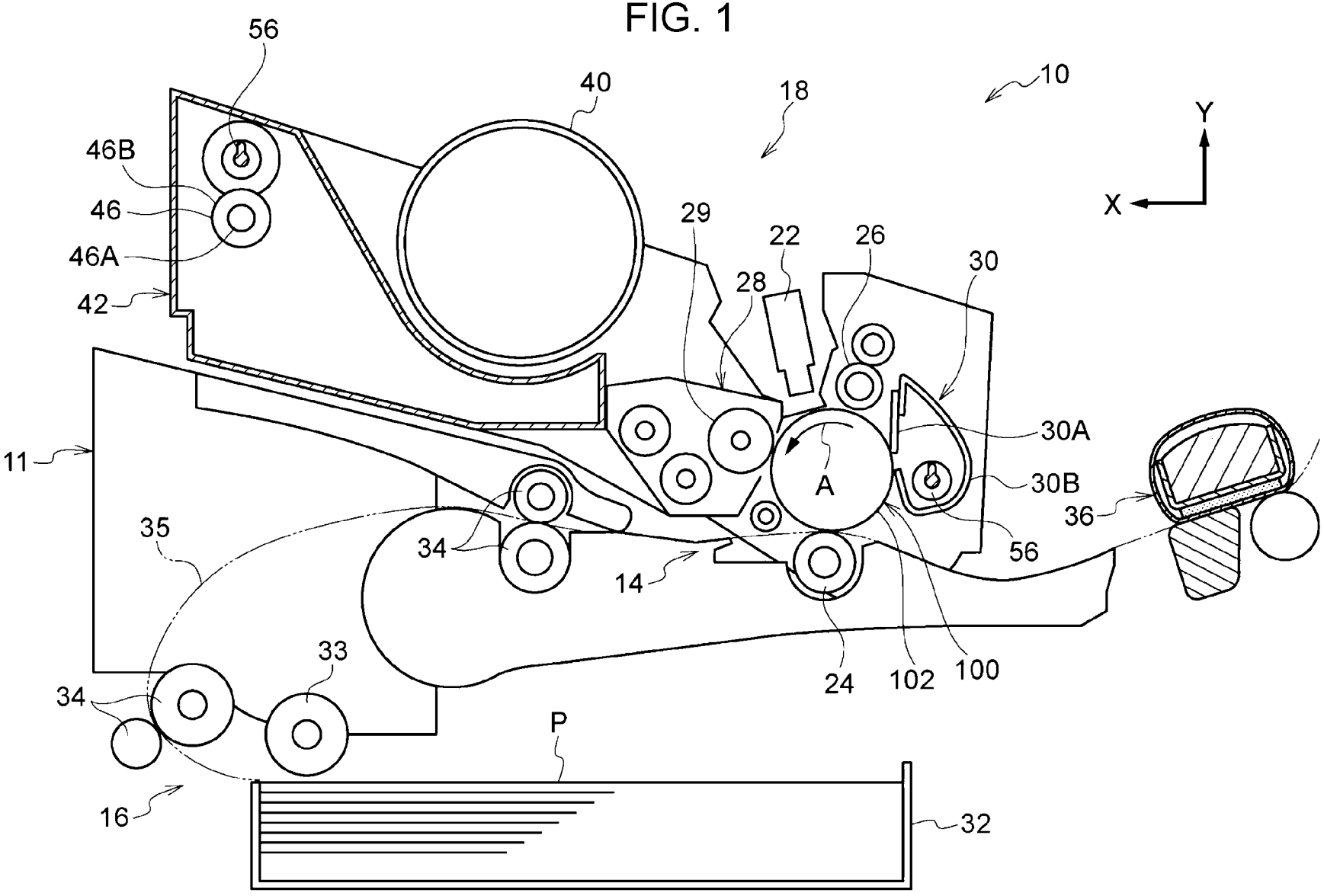
FIG. 1 illustrates the structure of an image forming apparatus including a photoconductor unit according to an exemplary embodiment.

As illustrated in FIG. 1, the image forming apparatus 10 includes a storage unit 32 that stores recording media P, such as sheets of paper, as an example of transfer objects; an image forming unit 14 that forms an image on each recording medium P; a fixing device 36 that fixes the image formed on the recording medium P by the image forming unit 14 to the recording medium P; and a transport unit 16 that transports the recording medium P from the storage unit 32 to the image forming unit 14.

The image forming unit 14 has a function of forming an image on the recording medium P by using developer containing toner. More specifically, the image forming unit 14 includes a photoconductor unit 100 including a cylindrical photoconductor 102, which is an example of an image carrier that carries an image (latent image). The photoconductor 102 and the photoconductor unit 100 will be described below.

The photoconductor unit 100 (photoconductor 102) is configured to rotate in one direction (direction of arrow A). A charging roller 26, which is an example of a charging unit, an exposure device 22, which is an example of an electrostatic-latent-image-forming unit, a developing device 28, which is an example of a developing unit, a transfer roller 24, which is an example of a transfer unit, and a removing unit 30 are arranged around the photoconductor unit 100 (photoconductor 102) in that order from the upstream side in the rotation direction of the photoconductor unit 100.

The charging roller 26 has a function of charging the photoconductor 102 of the photoconductor unit 100. The exposure device 22 has a function of irradiating the photoconductor 102 charged by the charging roller 26 with light to form an electrostatic latent image on the photoconductor 102.

The developing device 28 has a function of developing the electrostatic latent image formed on the photoconductor 102 by the exposure device 22 into a toner image.

Figure 10:
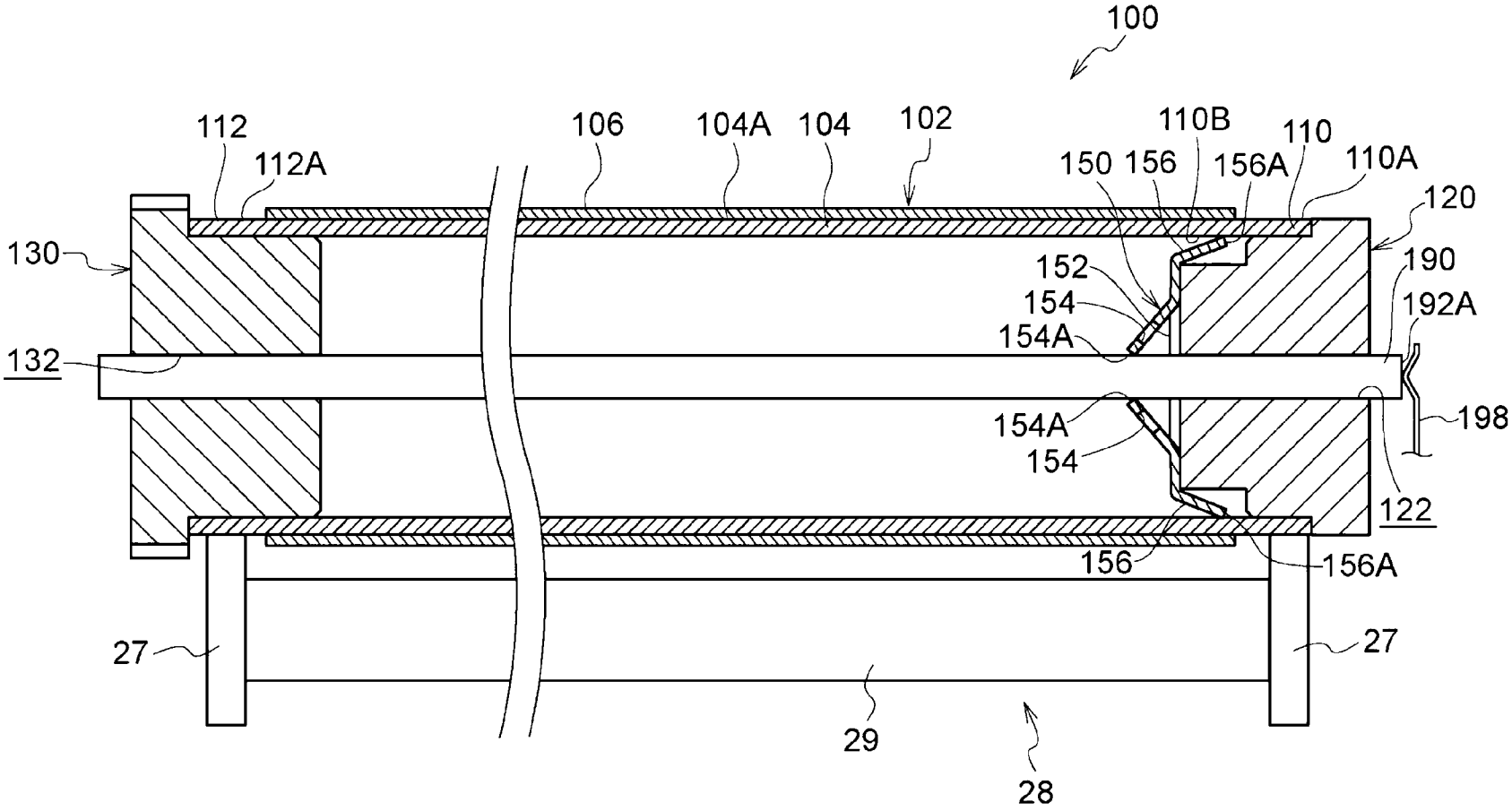
FIG. 10 is a partially sectioned view of a part of a developing device including the photoconductor unit according to the exemplary embodiment.

As illustrated in FIG. 10, the developing device 28 includes a developing roller 29 that carries the developer. Circular-plate-shaped restraining members 27 are provided at both ends of the developing roller 29 in the axial direction. The restraining members 27 are pressed against outer peripheral surfaces 110A and 112A of open end portions 110 and 112 of the photoconductor 102. Thus, a developing gap is provided between the developing roller 29 and the photoconductor 102.

Referring to FIG. 1, the transfer roller 24 has a function of transferring the toner image formed on the photoconductor 102 by the developing device 28 onto the recording medium P.

The removing unit 30 has a function of removing the toner that remains on the surface of the photoconductor 102 after the transfer process. More specifically, the removing unit 30 includes a blade 30A and a receiving portion 30B. The blade 30A serves as a removing member that comes into contact with the surface of the photoconductor 102 and removes (scrapes off) the toner. The receiving portion 30B receives the toner removed by the blade 30A.

The transport unit 16 includes a feed roller 33 that feeds the recording media P stored in the storage unit 32; a transport path 35 along which the recording media P fed by the feed roller 33 are transported; and plural pairs of transport rollers 34 that are arranged along the transport path 35 and that transport each recording medium P fed by the feed roller 33 to a gap between the photoconductor 102 and the transfer roller 24.

The fixing device 36 applies heat and pressure to the recording medium P to fix the toner image that has been transferred to the recording medium P by the transfer roller 24 to the recording medium P.

Figure 2:
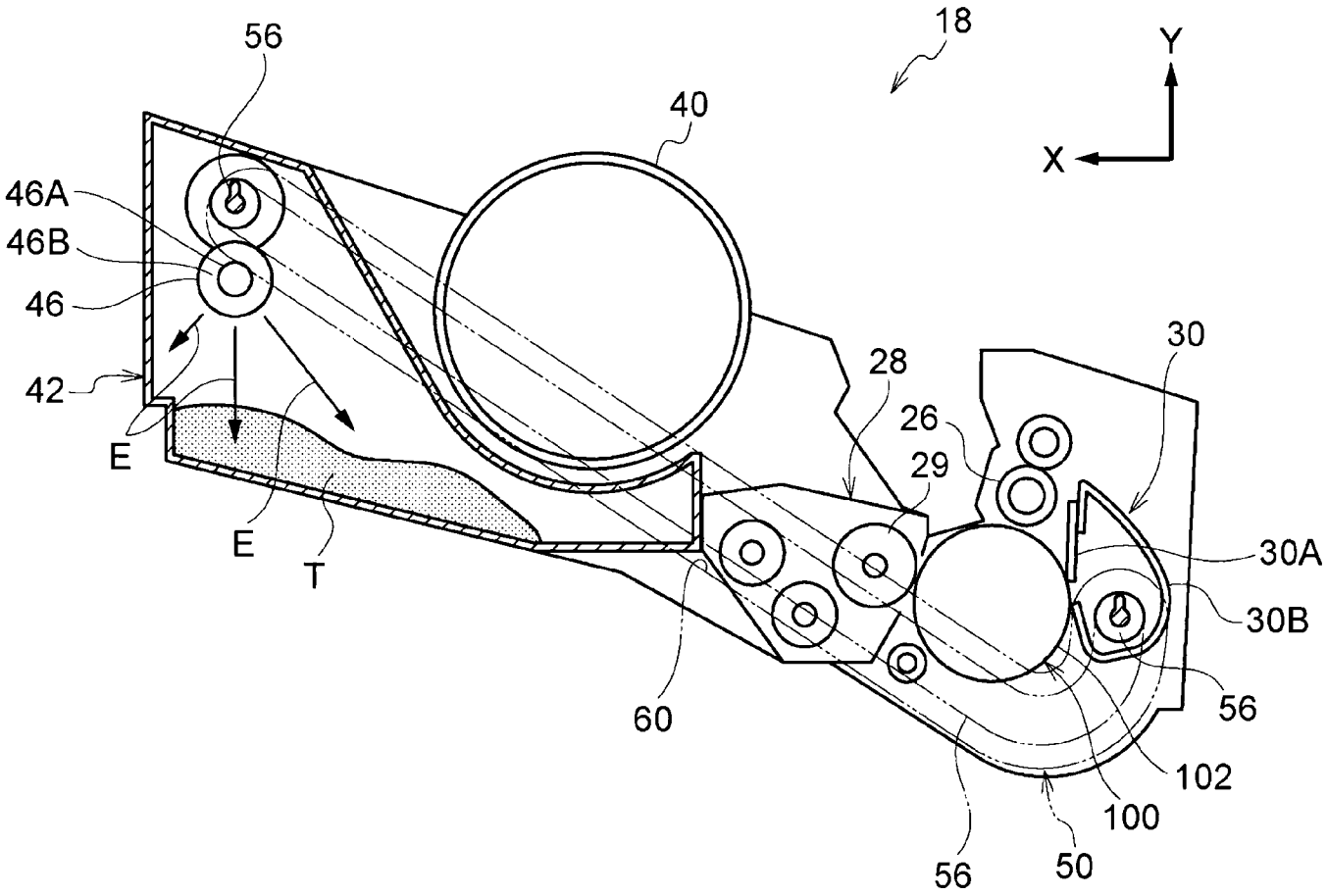
FIG. 2 illustrates the structure of a process cartridge including the photoconductor unit according to the exemplary embodiment.

As illustrated in FIGS. 1 and 2, the image forming apparatus 10 includes a process cartridge 18 that is removably attached to an image forming apparatus body 11 (see FIG. 1). In the present exemplary embodiment, the process cartridge 18 includes the photoconductor unit 100, the charging roller 26, the developing device 28, and the removing unit 30 described above.

As illustrated in FIG. 2, the process cartridge 18 also includes a transport device 50 that transports the toner removed by the removing unit 30, and a waste toner box 42 that receives the toner transported by the transport device 50.

A transporting element 46 that transports the toner is disposed in the waste toner box 42. The transporting element 46 includes a shaft 46A and a blade 46B. The blade 46B is provided on the outer peripheral surface of the shaft 46A so as to extend helically around the axis of the shaft 46A. When the shaft 46A of the transporting element 46 rotates, the blade 46B transports the toner in the axial direction and radial direction (direction of arrows E in FIG. 2) of the shaft 46A.

The process cartridge 18 also includes a toner cartridge 40 that contains toner to be supplied to the developing device 28.

As illustrated in FIG. 2, the process cartridge 18 includes the transport device 50, which transports the toner removed by the removing unit 30, and the waste toner box 42, which receives the waste toner transported by the transport device 50. The waste toner box 42 and the removing unit 30 are disposed on opposite sides of the developing device 28 in the X direction.

The transport device 50 includes a transport path 60 and a transport member 56. The waste toner is transported from the receiving portion 30B of the removing unit 30 to the waste toner box 42 along the transport path 60. The transport member 56 is disposed in the transport path 60, and includes a blade that extends helically around an axis of a shaft (not shown). When the transport member 56 is rotated by a drive unit (not shown), the waste toner is transported from the receiving portion 30B of the removing unit 30 to the waste toner box 42.

Photoconductor Unit

The photoconductor unit 100 will now be described.

Figure 9:
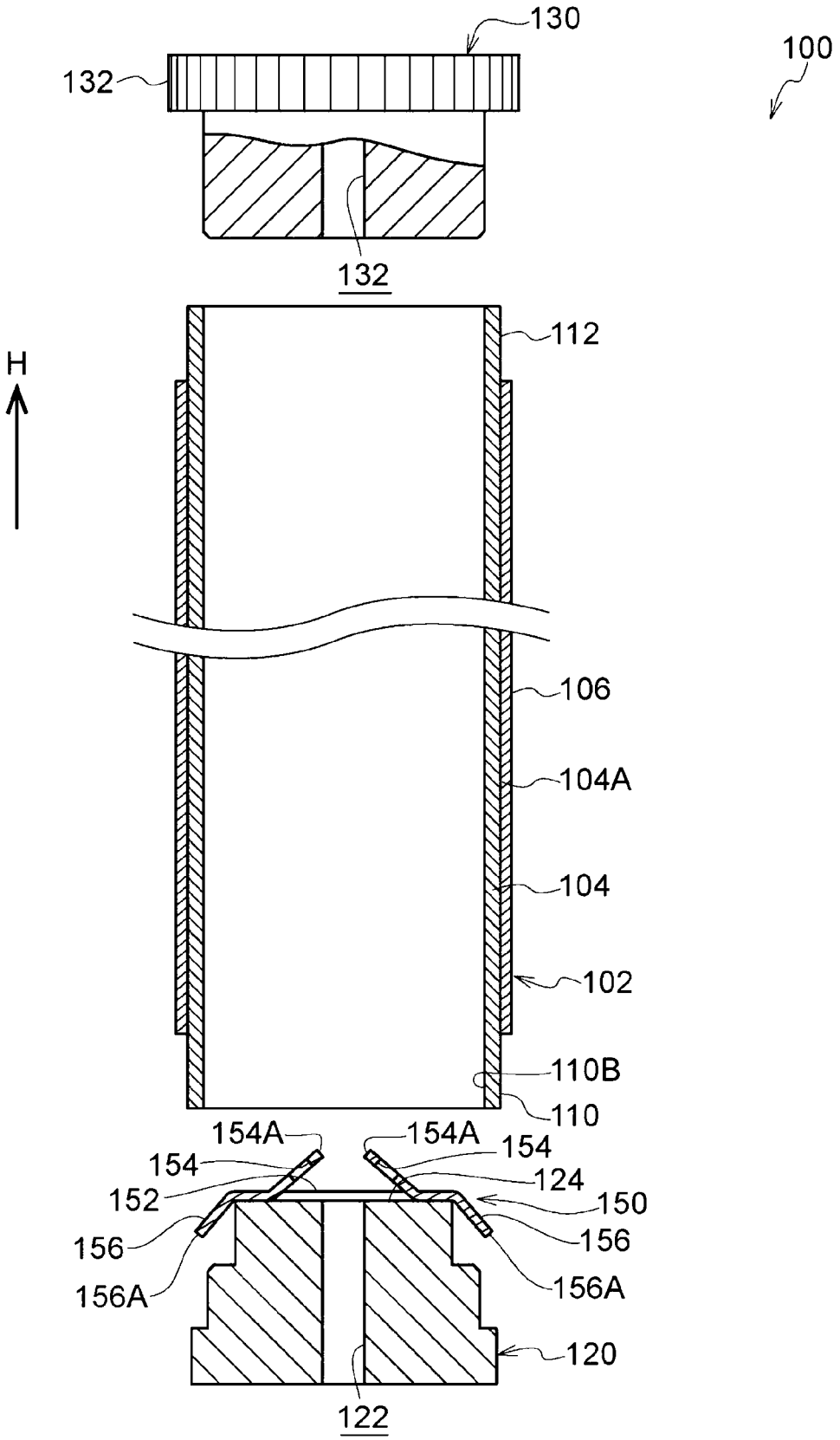
FIG. 9 illustrates a step of fitting flanges to the photoconductor.

As illustrated in FIGS. 9 and 10, the photoconductor unit 100 includes the cylindrical photoconductor 102, and also includes a ground plate 150 as an example of an electrode.

The photoconductor 102 includes a cylindrical base member 104 (see also FIG. 11) and a photosensitive layer 106 formed on an outer peripheral surface 104A of the base member 104. The photosensitive layer 106 includes an underlying layer (undercoat layer) formed on the outer peripheral surface 104A of the base member 104 and a protecting layer (overcoat layer) that is the surface layer. In FIGS. 9 and 10, the photosensitive layer 106 is illustrated such that the thickness thereof is greater than its actual thickness to provide better visibility.

A flange 120 is fitted to an open end portion 110 of the base member 104 of the photoconductor 102 at a first end thereof, and a flange 130 is fitted to an open end portion 112 of the base member 104 at a second end thereof. The flanges 120 and 130 respectively have through holes 122 and 132 at the centers thereof. A rotating shaft 190 (see FIG. 10) composed of a metal rod extends through the through holes 122 and 132.

The ground plate 150, which is made of a metal plate and is conductive, is attached to the flange 120. The ground plate 150 includes a circular-plate-shaped base plate portion 152. The base plate portion 152 is attached to an end face 124 of the flange 120. Plural inner lugs 154 having spring properties are formed at the center of the base plate portion 152 by cutting the base plate portion 152 and bending the cut portions upward. Plural outer lugs 156 having spring properties are formed at the radially outward periphery of the base plate portion 152. The outer lugs 156 extend radially outward beyond the end face 124 of the flange 120.

Referring to FIG. 10, the size of the space surrounded by the ends 154A of the inner lugs 154 is smaller than the diameter of the rotating shaft 190 in a free state. When the rotating shaft 190 is inserted through the through hole 122 in the flange 120, the ends 154A come into contact with the rotating shaft 190 and are elastically deformed.

The distance between the ends 156A of the outer lugs 156 is greater than the inner diameter of the base member 104 in a free state. When the flange 120 is fitted to the open end portion 110 of the photoconductor 102 (base member 104), the ends 156A come into contact with an inner peripheral surface 110B of the open end portion 110 of the base member 104 and are elastically deformed.

Thus, the inner lugs 154 of the ground plate 150 are in contact with the rotating shaft 190 in an elastically deformed state, and the outer lugs 156 of the ground plate 150 are in contact with the inner peripheral surface 110B of the open end portion 110 of the base member 104 of the photoconductor 102 in an elastically deformed state. An end portion 192A of the rotating shaft 190 is in contact with and grounded by a grounding member 198 provided on the image forming apparatus body 11 (see FIG. 1). Thus, the base member 104 of the photoconductor 102 is grounded through the ground plate 150, the rotating shaft 190, and the grounding member 198.

A gear 134 is formed on the peripheral surface of an end portion of the other flange 130. The gear 134 meshes with a gear of a driving mechanism (not shown) of the image forming apparatus body 11 (see FIG. 1).

As described below, the open end portion 110 at the first end of the base member 104 of the photoconductor 102, the open end portion 110 having the flange 120 provided with the ground plate 150 fitted thereto, has a hardness greater than that of the open end portion 112 at the second end.

Base Member

The base member 104 of the photoconductor 102 included in the photoconductor unit 100 will now be described.

The hardness of the base member 104 decreases with increasing distance from the open end portion 110 at the first end toward the open end portion 112 at the second end in the axial direction. As described above, the flange 120 provided with the ground plate 150 is fitted to the open end portion 110 at the first end, and the outer lugs 156 of the ground plate 150 are in contact with the inner peripheral surface 110B.

The difference in Vickers hardness between the open end portion 110 at the first end of the base member 104 and the open end portion 112 at the second end of the base member 104 is 3HV0.05 or greater, or approximately 3HV0.05 or greater. The Vickers hardness of the open end portion 110 at the first end of the base member 104 is 53HV0.05 or less, or approximately 53HV0.05 or less, and the Vickers hardness of the open end portion 112 at the second end of the base member 104 is 46HV0.05 or greater, or approximately 46HV0.05 or greater.

In the present exemplary embodiment, the Vickers hardness of the open end portion 110 at the first end of the base member 104 is 52HV0.05, and the Vickers hardness of the open end portion 112 at the second end of the base member 104 is 48HV0.05.

The wall thickness of the base member 104 is 400 μm or less, or approximately 400 μm or less. Also, the wall thickness of the base member 104 is 100 μm or greater, or approximately 100 μm or greater. In the present exemplary embodiment, the wall thickness of the base member 104 is in the range of 390 μm±10 μm.

Figure 11:
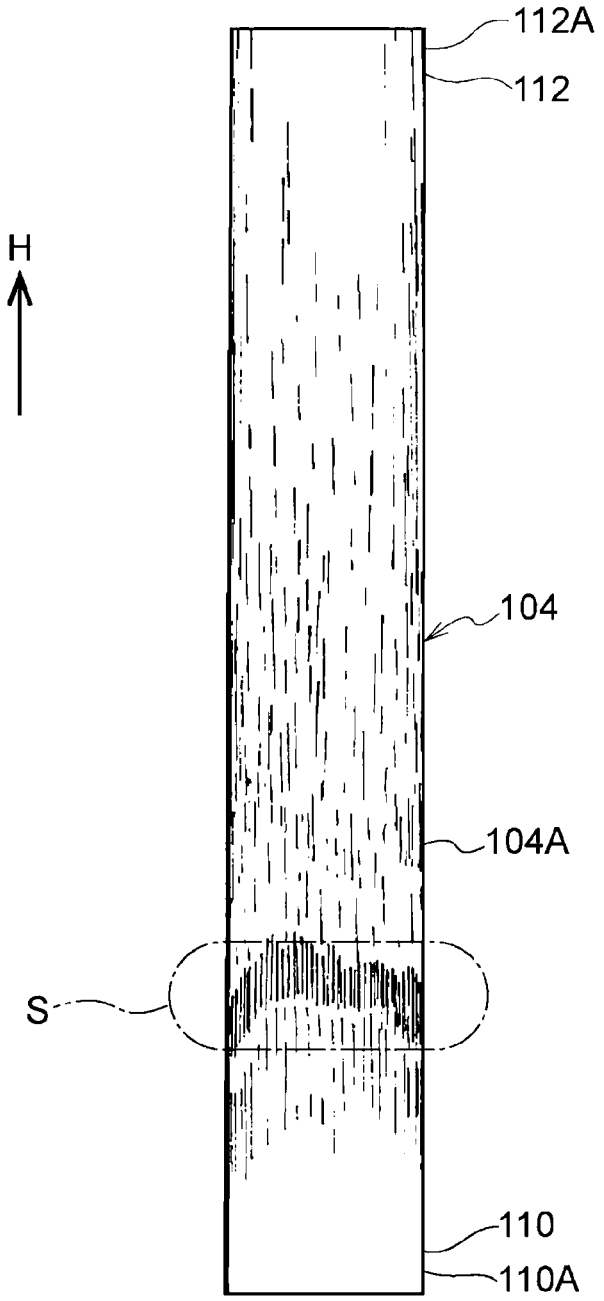
FIG. 11 illustrates an outer peripheral surface of the base member of the photoconductor included in the photoconductor unit according to the exemplary embodiment.

As illustrated in FIG. 11, shock lines S are formed on the outer peripheral surface 104A of the base member 104, and one of the open end portions that is closer to the shock lines S is the open end portion 110 at the first end. Thus, as illustrated in FIGS. 9 and 10, the flange 120 provided with the ground plate 150 is fitted to the open end portion 110 at the end near the shock lines S, and the outer lugs 156 of the ground plate 150 are in contact with the inner peripheral surface 110B. The shock lines S will be described below.

Method for Manufacturing Photoconductor Unit

An example of a process for manufacturing the photoconductor unit 100 will now be described.

In the drawings, the direction of arrow H does not change from the first step (FIG. 3A) to the last step (FIG. 9). In the present exemplary embodiment, the direction of arrow H is vertically upward.

Method for Manufacturing Base Member

A method for manufacturing the base member 104 will be described. The base member 104 is manufactured by forming the cylindrical member 206 (see FIG. 4) by impact processing and ironing the cylindrical member 206 into the base member 104 (see FIG. 8).

Impact Processing

As illustrated in FIGS. 3A to 4B, the impact processing is performed to form a slag 202 composed of a block of aluminum, which is an example of a block of metal, into the cylindrical member 206 having a bottom portion 205 at one end.

Figure 3C:
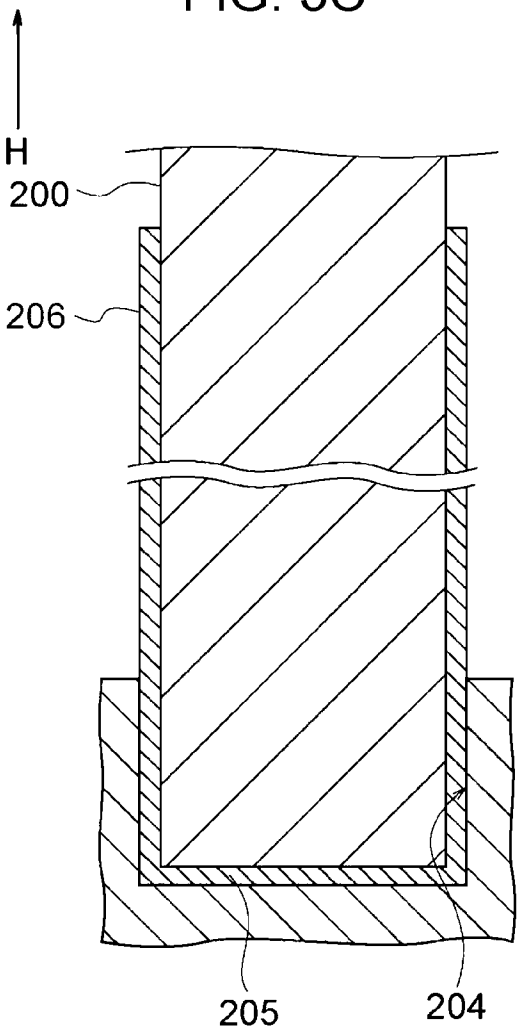
FIGS. 3A, 3B, and 3C illustrate steps for manufacturing a base member of a photoconductor included in the photoconductor unit.
Figure 3B:
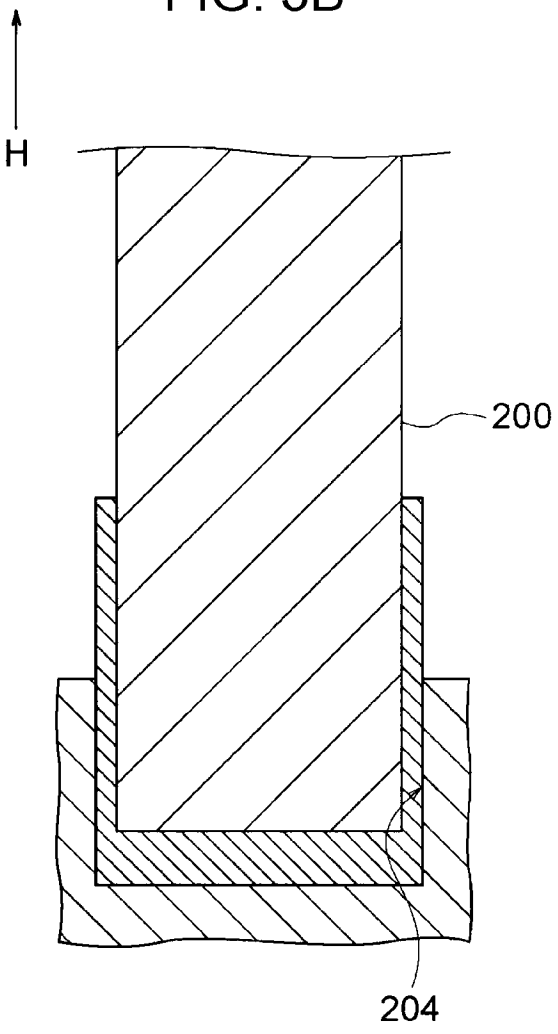
Figure 3A:
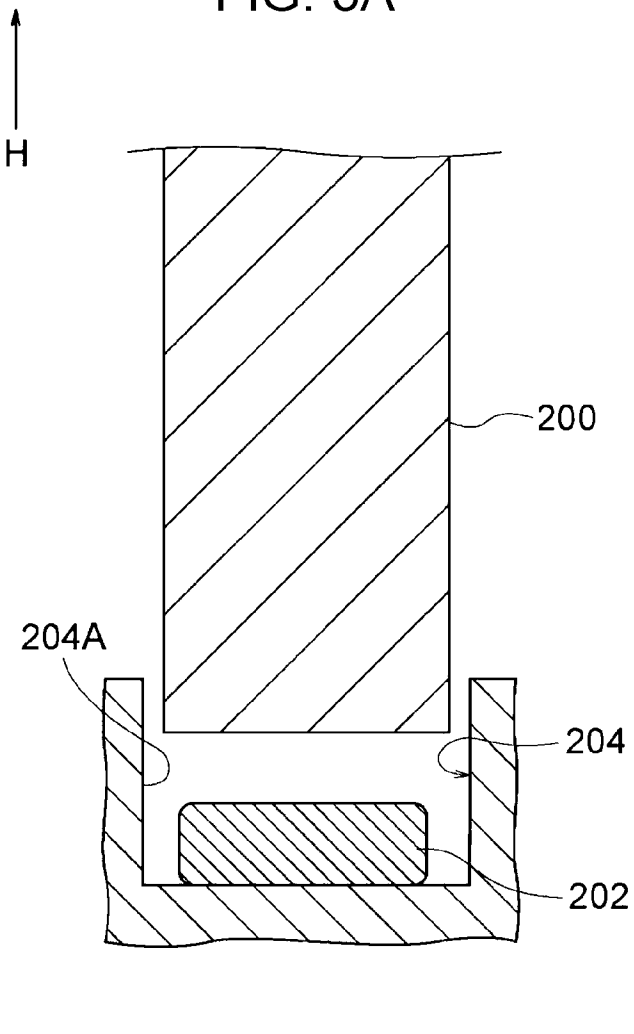

As illustrated in FIG. 3A, the impact processing is performed by using a recessed die 204, in which the slag 202 is placed, and a solid cylindrical punching die 200, which is an example of a first solid cylindrical die for pressing the slag 202 placed in the recessed die 204 to form the slag 202 into a cylindrical shape. The recess 204A in the recessed die 204 is circular, and has an inner diameter of, for example, 32.0 mm. The outer diameter of the punching die 200 is, for example, 30.6 mm.

As illustrated in FIG. 3A, in the impact processing, first, the slag 202 is placed in the recessed die 204, and the punching die 200 is positioned above the recessed die 204.

Next, as illustrated in FIGS. 3B and 3C, the punching die 200 is moved downward and pushed against the slag 202 placed in the recessed die 204 so that the slag 202 is deformed. The slag 202 is deformed along the peripheral surface of the punching die 200, and is formed into the cylindrical member 206 having the bottom portion 205 (see FIG. 3C). The wall thickness of the cylindrical member 206 is, for example, 0.7 mm, and the inner diameter of the cylindrical member 206 is, for example, 30.6 mm.

Figure 4B:
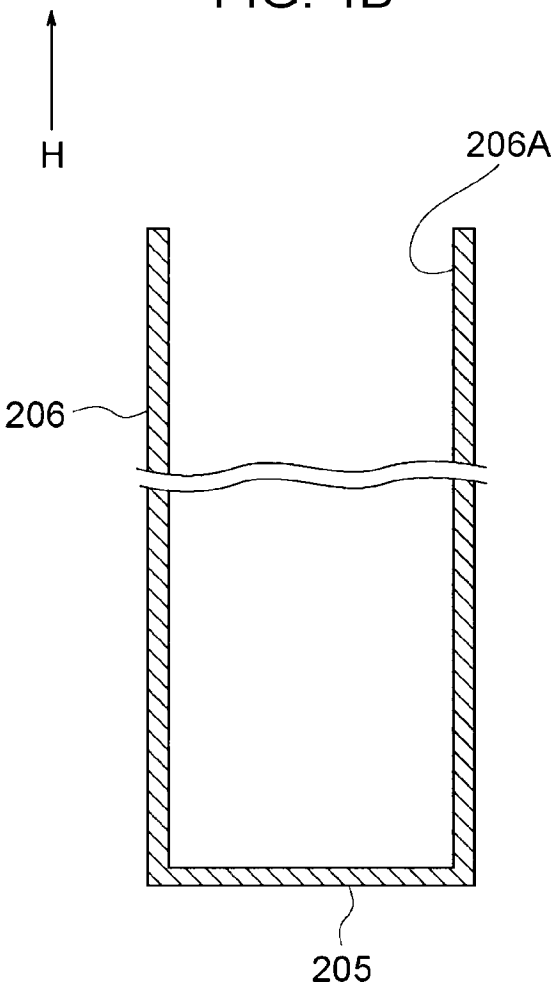
FIGS. 4A and 4B illustrate steps for manufacturing the base member of the photoconductor included in the photoconductor unit.
Figure 4A:
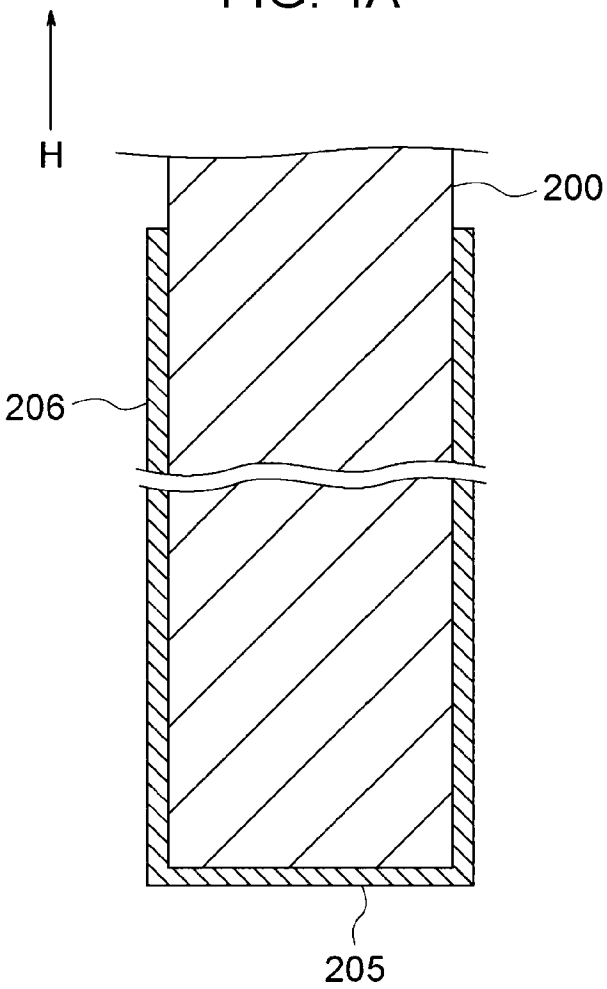

Next, as illustrated in FIG. 4A, the punching die 200 is moved upward so that the cylindrical member 206, which is in close contact with the punching die 200, is removed from the recessed die 204.

Then, as illustrated in FIG. 4B, the cylindrical member 206 is pulled off (removed) from the punching die 200.

Ironing

The ironing is performed to reduce the wall thickness of the cylindrical member 206 and reshape the cylindrical member 206.

Figure 5:
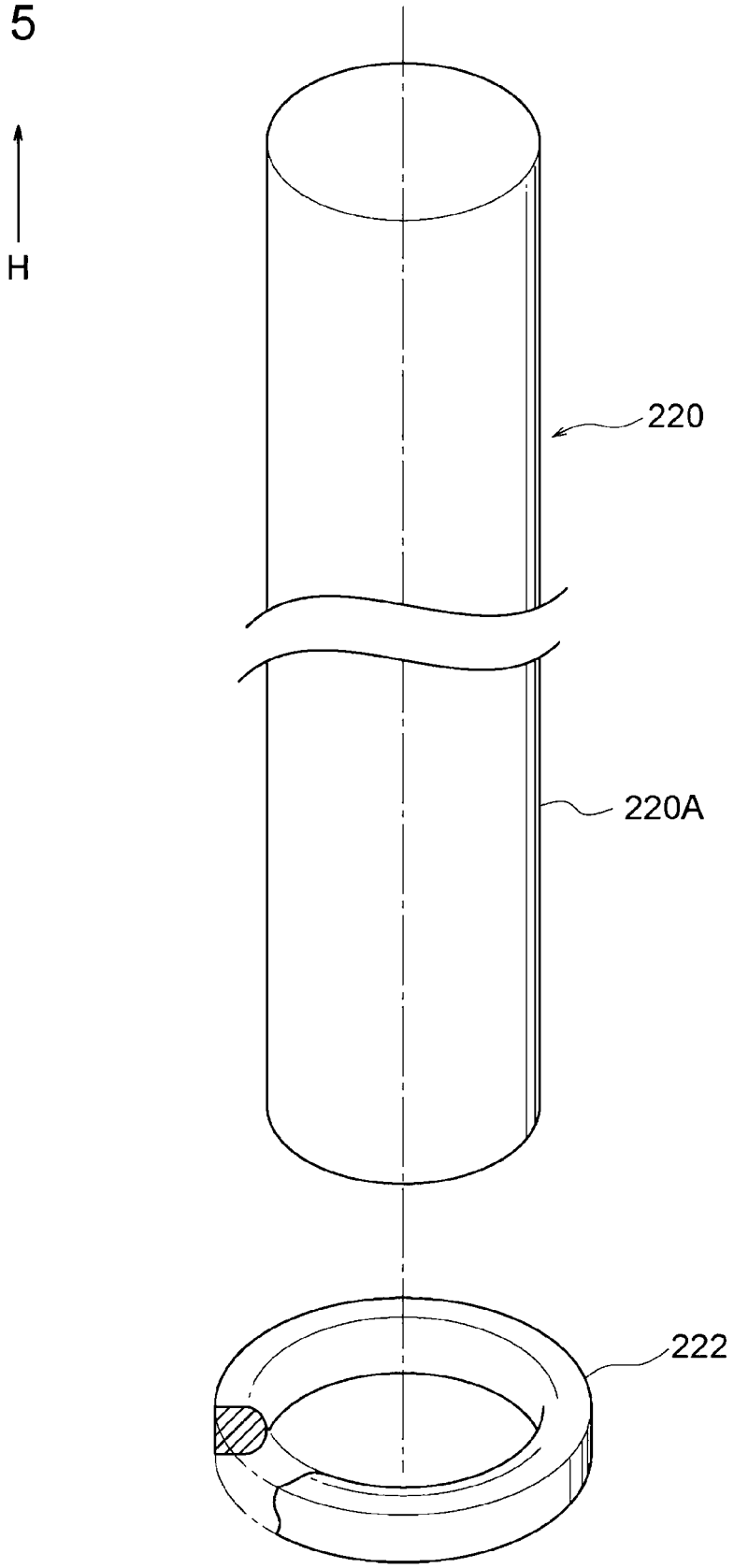
FIG. 5 is a perspective view of a punching die and an ironing die used in an ironing step for manufacturing the base member of the photoconductor included in the photoconductor unit.

As illustrated in FIG. 5, the ironing is performed by using a punching die 220, which is an example of a second solid cylindrical die that is inserted into the cylindrical member 206 (see FIG. 3B) from an end (bottom end in FIG. 5) thereof, and an annular die 222, which enables the inner peripheral surface 206A of the cylindrical member 206 (see FIG. 3B) to follow the outer peripheral surface 220A of the punching die 220.

The punching die 220 has a solid cylindrical shape that extends in the vertical direction (one direction), and an outer diameter thereof is, for example, 29.2 mm. The annular die 222 has an annular shape, and an inner diameter thereof is, for example, 30.0 mm.

Figures 6A, 6B, 6C:
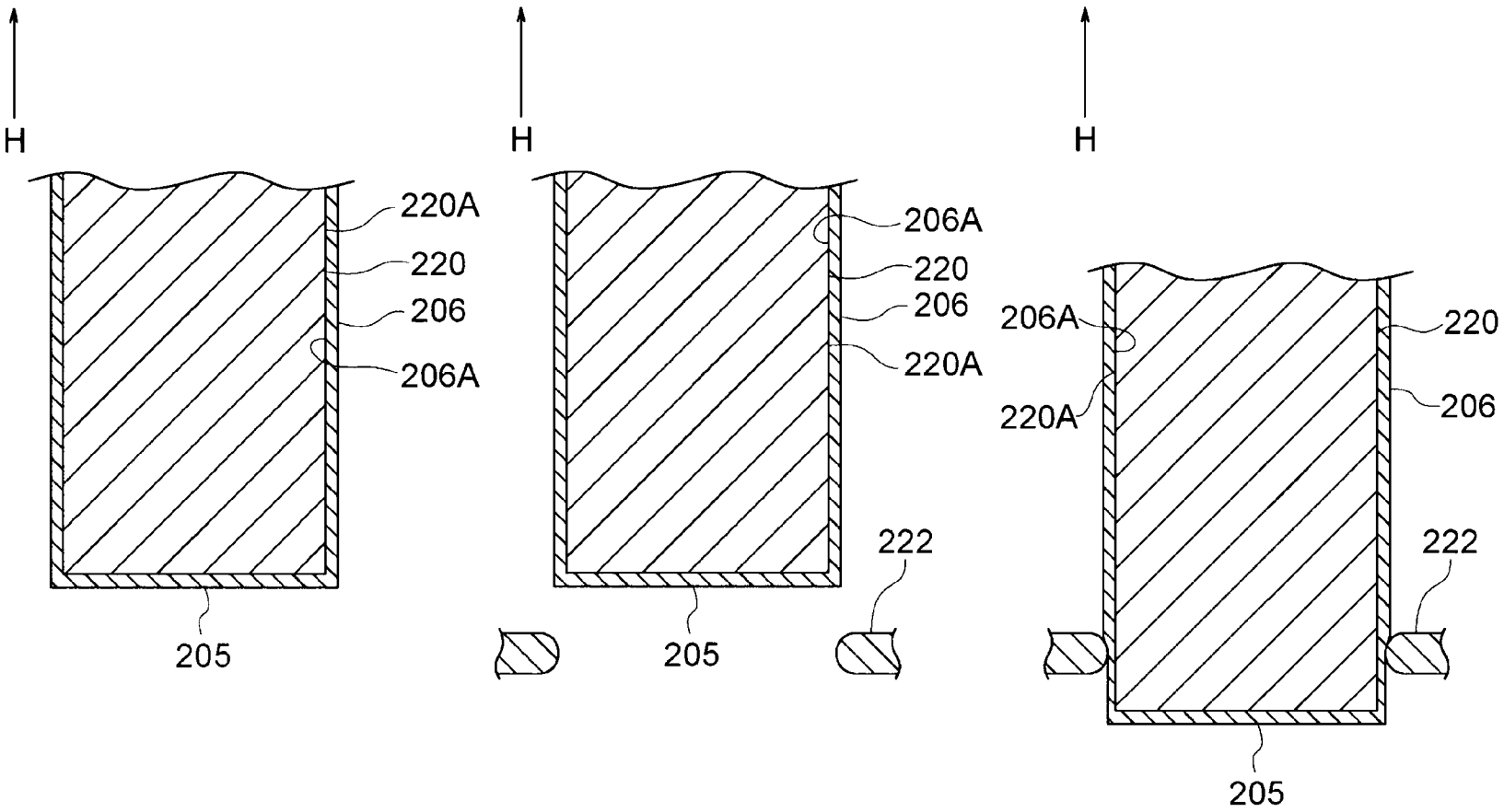
FIGS. 6A, 6B, and 6C illustrate steps for manufacturing the base member of the photoconductor included in the photoconductor unit.
Figure 7C:
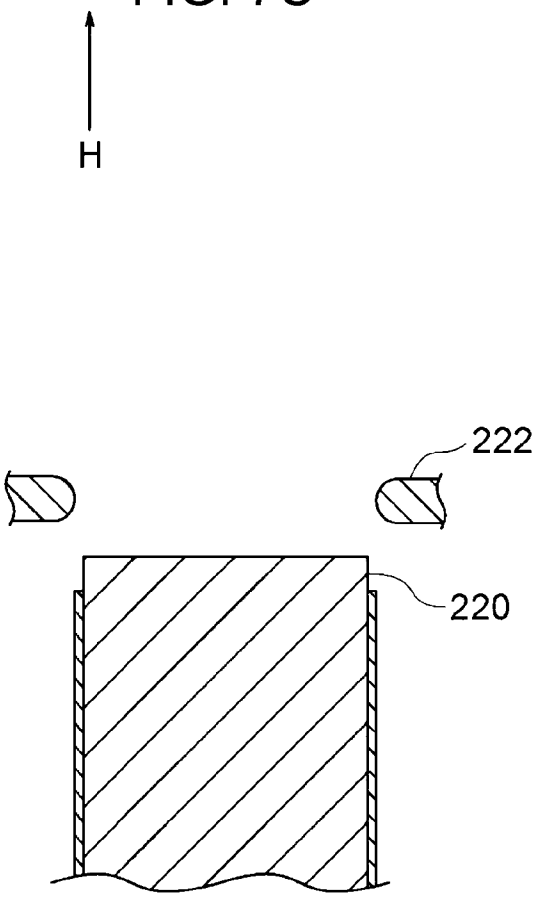
FIGS. 7A, 7B, and 7C illustrate steps for manufacturing the base member of the photoconductor included in the photoconductor unit.
Figure 7B:
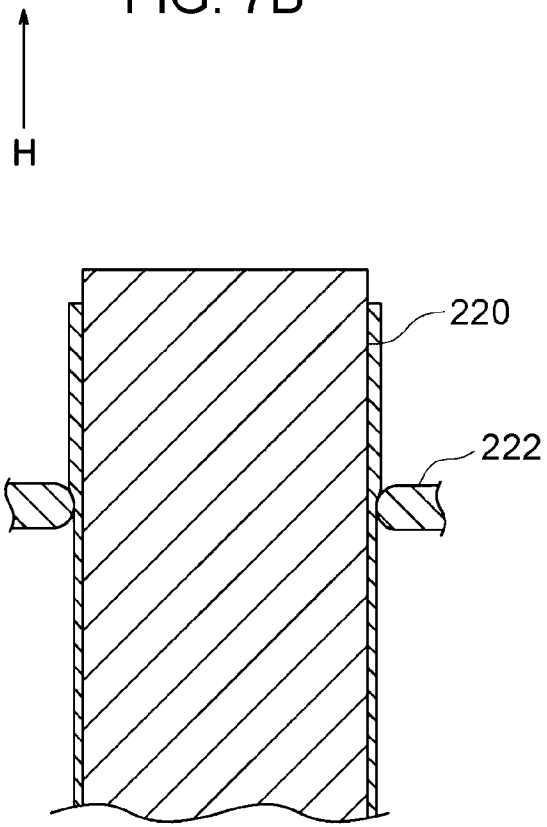
Figure 7A:
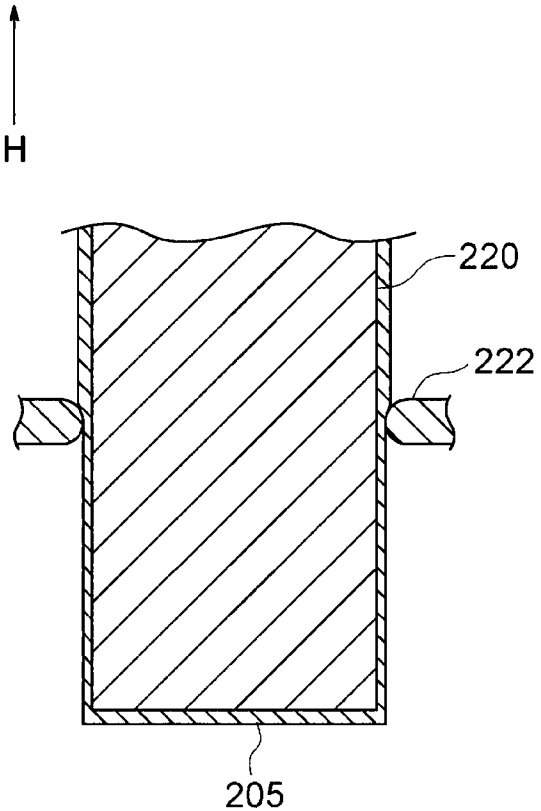

As illustrated in FIG. 6A, the ironing is performed by first inserting the punching die 220 into the cylindrical member 206 from the end of the first inserting the punching die 220. In FIGS. 6A, 6B, 6C, 7A, and 7B, a gap provided between the outer peripheral surface 220A of the punching die 220 and the inner peripheral surface 206A of the cylindrical member 206 is not illustrated.

Then, as illustrated in FIGS. 6B, 6C, 7A, 7B, and 7C, the cylindrical member 206 in which the punching die 220 is inserted is moved downward from a position above the annular die 222 so that the cylindrical member 206 passes through the annular die 222. Accordingly, the annular die 222 presses the cylindrical member 206 against the punching die 220, so that the cylindrical member 206 is reduced in wall thickness and is shaped so that the inner peripheral surface 206A of the cylindrical member 206 follows the outer peripheral surface 220A of the punching die 220.

Figure 8C:
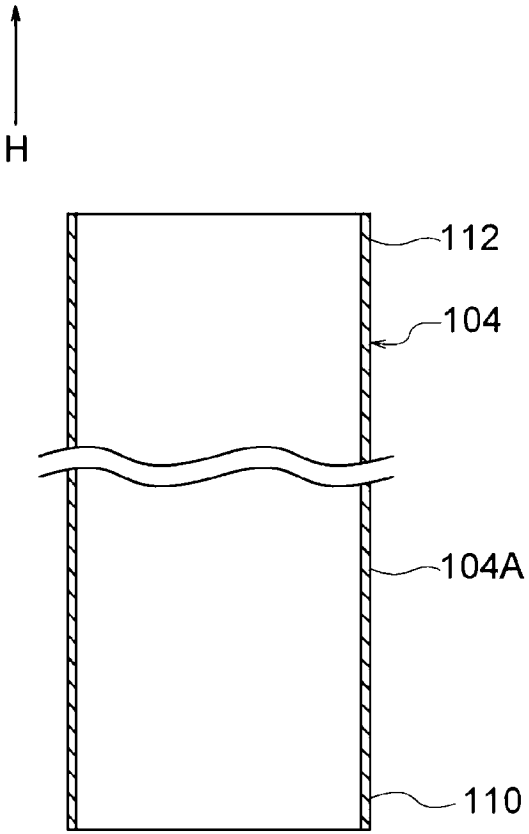
FIGS. 8A, 8B, and 8C illustrate steps for manufacturing the base member of the photoconductor included in the photoconductor unit.
Figure 8B:
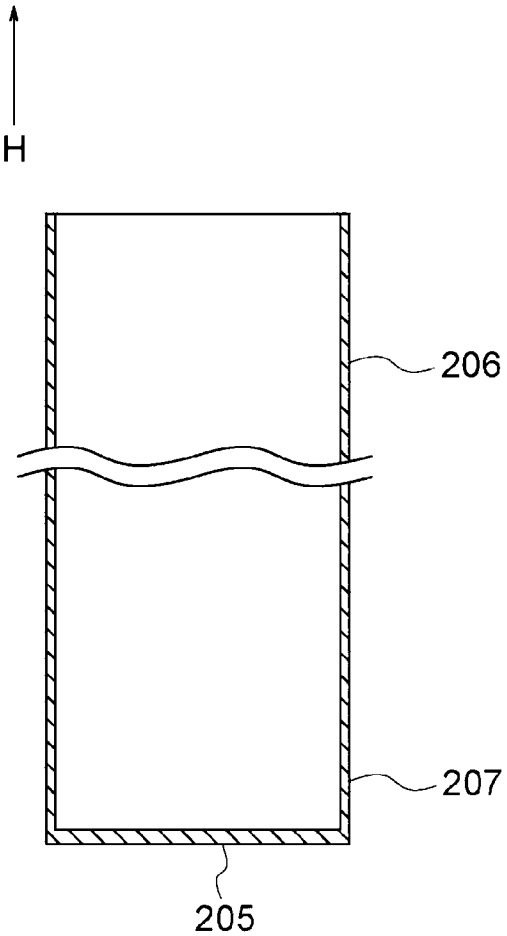
Figure 8A:
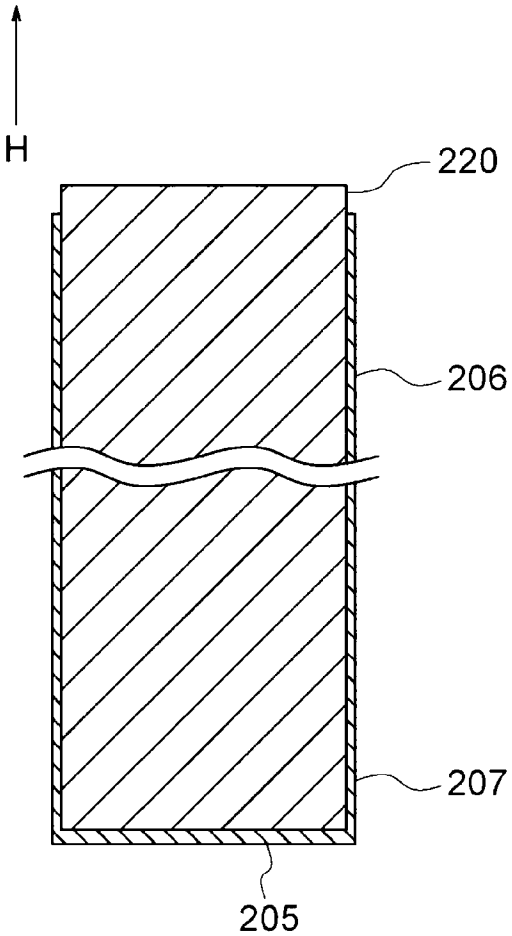

Then, as illustrated in FIG. 8A and 8B, the cylindrical member 206 is pulled off (removed) from the punching die 220.

Cutting Step

A cutting step is performed to cut off a lower end portion 207 of the cylindrical member 206 that includes the bottom portion 205. Thus, as illustrated in FIG. 8C, the cylindrical base member 104 that is open at both ends thereof is obtained.

Photosensitive Layer Forming Step

A photosensitive layer forming step will now be described.

The photosensitive layer forming step is performed to form the photosensitive layer 106 on the outer peripheral surface 104A of the cylindrical base member 104 illustrated in FIGS. 8C and 11. The type and structure of the photosensitive layer 106 are not limited, and any photosensitive layer may be used. In addition, the manufacturing method of the photosensitive layer 106 is also not limited, and any method may be used. According to the present exemplary embodiment, the photosensitive layer has a multilayer structure in which an underlying structure (undercoat layer), a charge generation layer, and a charge transport layer are stacked together.

Electrode Attaching Step

An electrode attaching step will now be described.

In the electrode attaching step, as illustrated in FIGS. 9 and 10, the flange 120 is fitted to the open end portion 110 at the first end (high-hardness end) of the base member 104 of the photoconductor 102, and the flange 130 is fitted to the open end portion 112 at the second end (low-hardness end). When the flange 120, which is provided with the ground plate 150, is fitted to the open end portion 110 at the first end, the outer lugs 156 of the ground plate 150 come into contact with the inner peripheral surface 110B of the open end portion 110.

Hardness Distribution of Base Member in Axial Direction and Outer Peripheral Surface of Base Member The hardness distribution of the manufactured base member 104 in the axial direction and the outer peripheral surface 104A of the base member 104 will now be described.

When the slag 202 is pressed and deformed by the punching die 200 by impact processing so that the slag 202 extends upward along the peripheral surface of the punching die 200 and is formed into the cylindrical member 206 having a bottom, the hardness of the base member 104 varies in the axial direction. More specifically, the hardness is high at a side toward which the punching die 200 moves to press the slag 202 (lower side in the direction opposite to the direction of arrow H) and at which the bottom portion 205 is provided, and decreases with increasing distance toward the other side, that is, toward the upper side.

This is basically because the crystal density is high at the lower side at which the slag 202 is pressed, and is low at the upper side toward which the slag 202 expands along the peripheral surface of the punching die 200.

The shock lines S (see FIG. 11) are formed on the outer peripheral surface 104A of the base member 104 at a location near the bottom portion 205. As illustrated in FIG. 11, the shock lines S remain after the cutting step in which the lower end portion 207 including the bottom portion 205 is cut off.

The shock lines are line-shaped thickness reduction marks that are basically formed when the slag 202 suddenly receives a tensile force in an early stage of the impact processing so that the thickness thereof is reduced.

Operation

The operation of the present exemplary embodiment will now be described.

As described above, the hardness of the base member 104 according to the present exemplary embodiment decreases with increasing distance from the open end portion 110 at the first end toward the open end portion 112 at the second end in the axial direction.

In addition, in the photoconductor unit 100 according to the present exemplary embodiment, the flange 120 provided with the ground plate 150 is fitted to the open end portion 110, which is near the shock lines S on the base member 104 and at which the hardness is relatively high. Accordingly, the outer lugs 156 of the ground plate 150 are in contact with the inner peripheral surface 110B in an elastically deformed state.

Figure 12:
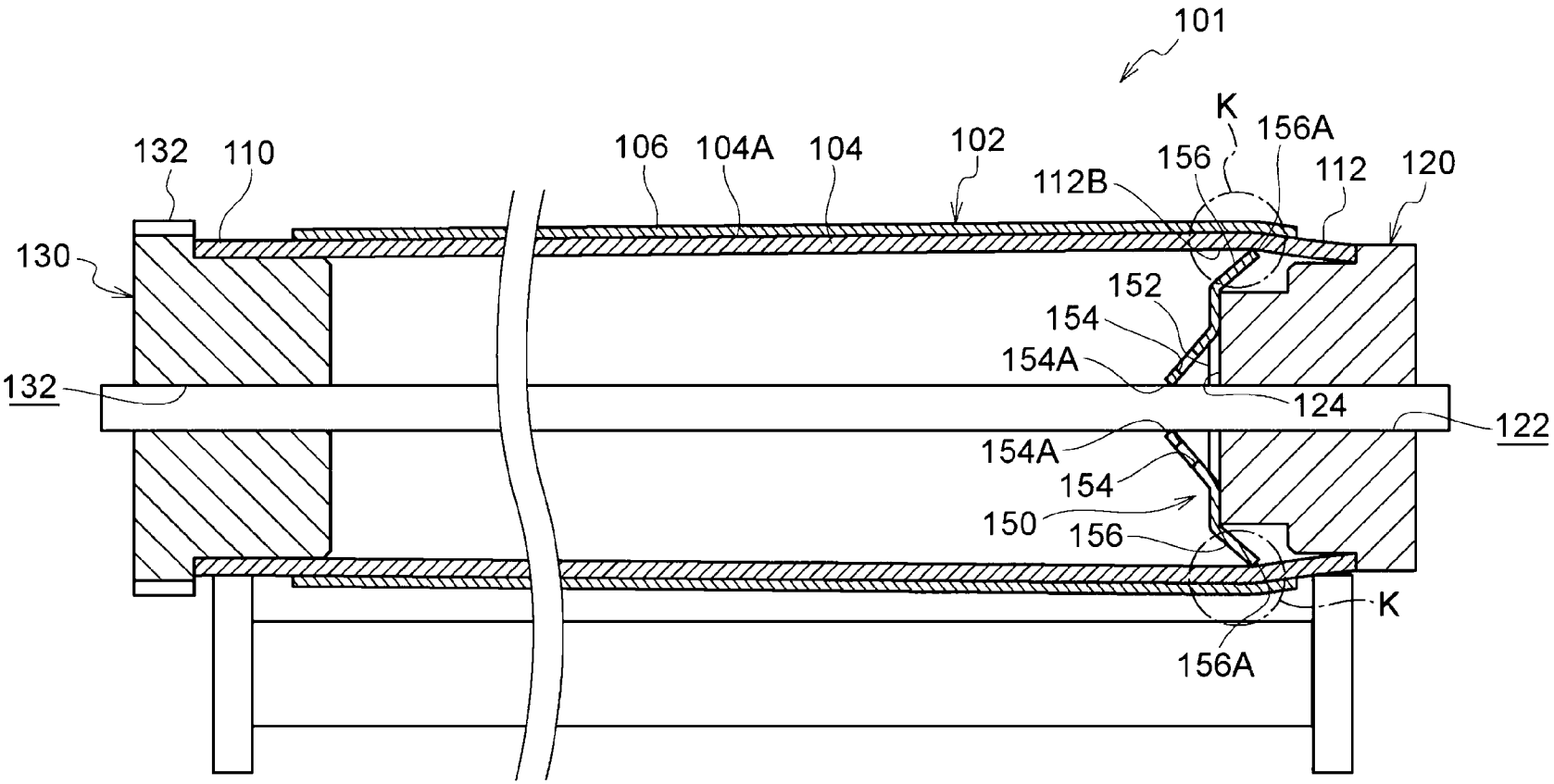
FIG. 12 RELATED ART
FIG. 12 is a partially sectioned view that corresponds to FIG. 10 and illustrates a part of a developing device including a photoconductor unit according to a comparative example.

In a photoconductor unit 101 according to a comparative example illustrated in FIG. 12, the flange 120 provided with the ground plate 150 is fitted to the open end portion 112 at the second end that is opposite to the end near the shock lines S on the base member 104, that is, at end where the hardness is low. The outer lugs 156 of the ground plate 150 are in contact with the inner peripheral surface 112B. Therefore, the open end portion 112 is easily deformed by the pressing force applied by the elastically deformed outer lugs 156 (see part K in FIG. 12). Thus, the developing gap between the developing roller 29 and the photoconductor 102 easily varies due to deformation of the open end portion 112, and accordingly an image with non-uniform density, for example, is easily formed.

In contrast, in the photoconductor unit 100 according to the present exemplary embodiment, the flange 120 is fitted to the open end portion 110 at the end that is near the shock lines S and at which the hardness is relatively high, and the outer lugs 156 of the ground plate 150 are in contact with the inner peripheral surface 110B. Therefore, deformation of the open end portions 110 and 112 is smaller than that in the photoconductor unit 101 according to the comparative example. Thus, the risk that an image with non-uniform density, for example, will be formed due to deformation of the open end portions 110 and 112 may be reduced.

In the base member 104 of the photoconductor unit 100 according to the present exemplary embodiment, the difference in Vickers hardness between the open end portion 110 at the first end and the open end portion 112 at the second end is 3HV0.05 or greater, or approximately 3HV0.05 or greater, and the hardness of the open end portion 112 at the second end is relatively low. Since the ground plate 150 is in contact with the inner peripheral surface 110B of the open end portion 110 having a relatively high hardness, deformation of the open end portion 110 may be reduced.

In the base member 104 according to the present exemplary embodiment, although the difference in Vickers hardness between the open end portion 110 at the first end and the open end portion 112 at the second end is 3HV0.05 or greater, or approximately 3HV0.05 or greater, the Vickers hardnesses are in the range of 53HV0.05 or less, or approximately 53HV0.05 or less, and 46HV0.05 or greater, or approximately 46HV0.05 or greater. Therefore, the difference in rigidity (difference in hardness) in the axial direction is smaller than that in the case where the Vickers hardness is greater than 53HV0.05 at the first end and less than 46HV0.05 at the other end. Thus, deformation of the base member 104 due to a large difference in rigidity (hardness) may be reduced.

Even when the base member 104 has a wall thickness of 400 μm or less, or approximately 400 μm or less, and is easily deformed, deformation of the open end portions 110 and 112 may be reduced.

The rigidity of the base member 104 is higher than that in the case where the wall thickness of the base member 104 is less than 100 μm. Therefore, deformation of the base member 104 due to insufficient rigidity may be reduced.

Others

The present invention is not limited to the above-described exemplary embodiment.

For example, the shape of the ground plate 150, which is an example of an electrode, is not limited to that in the above-described exemplary embodiment, and may be various other shapes.

In addition, although the process cartridge 18 includes the photoconductor unit 100, the charging roller 26, the developing device 28, and the removing unit 30 in the above-described exemplary embodiment, the process cartridge is not limited to this as long as at least the photoconductor unit 100 and the charging roller 26 are included. In addition, a charging unit other than the charging roller 26, such as a scorotron charging device, may instead be used.

Although the wall thickness of the base member 104 is 400 μm or less, or approximately 400 μm or less, in the above-described exemplary embodiment, the wall thickness of the base member 104 is not limited to this. The present invention may also be applied to a base member 104 having a wall thickness greater than 400 μm.

When the wall thickness of the base member is uniform or substantially uniform, the rigidity generally increases as the hardness increases. Accordingly, the ground plate (example of an electrode) may be arranged to be in contact with the inner peripheral surface of one of the open end portions of the base member having a higher rigidity. For example, a predetermined load may be applied to the open end portions of the base member, and the ground plate (example of an electrode) may be arranged to be in contact with the inner peripheral surface of one of the open end portions with less deformation (higher rigidity).

The structure of the image forming apparatus is not limited to that in the above-described exemplary embodiment, and the image forming apparatus may have various other structures. In addition, various embodiments are possible within the gist of the present invention.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiments was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A photoconductor unit comprising:

a photoconductor including a base member that is cylindrical, and a photosensitive layer formed on an outer peripheral surface of the base member; and an electrode that is in contact with an inner peripheral surface of an open end portion of the base member at an end that is closer to a shock line than the other end is, the shock like being formed on the outer peripheral surface of the base member.

2. The photoconductor unit according to claim 1, wherein a wall thickness of the base member is approximately 400 μm or less.

3. The photoconductor unit according to claim 2, wherein the wall thickness of the base member is approximately 100 μm or greater.

4. A process cartridge comprising:

the photoconductor unit according to claim 1; and a charging unit that charges a surface of the photoconductor included in the photoconductor unit.

5. An image forming apparatus comprising:

the photoconductor unit according to claim 1;

a charging unit that charges a surface of the photoconductor included in the photoconductor unit;

an electrostatic-latent-image-forming unit that forms an electrostatic latent image on the charged surface of the photoconductor;

a developing unit that develops the electrostatic latent image formed on the surface of the photoconductor into a toner image by using developer containing toner; and a transfer unit that transfers the toner image onto a transfer object.

* * * * *